US005492063A

United States Patent [19]

Dittrich

[11] Patent Number: 5,492,063

[45] Date of Patent: Feb. 20, 1996

[54] REDUCED ENERGY CARTRIDGE

[75] Inventor: William A. Dittrich, Denville, N.J.

[73] Assignees: SNC Industrial Technologies Inc.; Les Technologies Industrielles SNC, both of Montreal, Canada

[21] Appl. No.: 331,969

[22] Filed: Oct. 31, 1994

Related U.S. Application Data

[63] Continuation-in-part of Ser. No. 773,591, Jan. 21, 1992, Pat. No. 5,359,937, which is a continuation-in-part of Ser. No. 497,027, Mar. 22, 1990, abandoned.

[51] Int. Cl.[6] ..... F42B 5/02

[52] U.S. Cl. ..... 102/430; 102/444; 102/464; 102/530; 89/14.5

[58] Field of Search ..... 102/430, 434, 102/439, 444, 445, 446, 447, 464, 466, 467, 469, 470, 472, 530, 531; 89/179, 14.5

[56] References Cited

U.S. PATENT DOCUMENTS

| | | | |
|---|---|---|---|
| 3,477,375 | 11/1969 | Barr | 102/470 |
| 4,686,905 | 8/1987 | Szabo | 102/444 |
| 5,016,536 | 5/1991 | Brighton | 102/430 |

FOREIGN PATENT DOCUMENTS

| | | | |
|---|---|---|---|
| 2388242 | 11/1978 | France . | |
| 2822624 | 12/1978 | Germany | 102/444 |

*Primary Examiner*—Harold J. Tudor

[57] ABSTRACT

A two part cartridge has a rearwardly recoiling inner piston and a choked orifice at its forward end to develop a blow-back thrust that will cycle a recoil operated automatic firearm. The piston itself may serve to contain propellant and preferably contains all propellant within the cartridge.

9 Claims, 5 Drawing Sheets

REDUCED ENERGY CARTRIDGE

This application is a continuation-in-part of my prior U.S. application Ser. No. 07/773,591 (PCT/CA91/00090) filed 21 Jan., 1992, now U.S. Pat. No. 5,359,937, with an international filing date of 22 Mar., 1991, being in turn a continuation-in-part of Ser. No. 07/497,027, filed 22 Mar., 1990, now abandoned.

BACKGROUND OF THE INVENTION

In general, the present invention relates to the field of ordinance and, more specifically, to non-lethal ammunition used in training and war games.

FIELD OF THE INVENTION

Normal automatic and semi-automatic weapons are actuated conventionally either by the expansion of propellant gas against a piston connected to the recoiling bolt mass or by direct blowback of the cartridge case against the bolt upon expansion of the propellant gas during the ballistic cycle of the ammunition. In these systems, the energy provided to the recoil mechanism is somewhat dependant on that imparted to the projectile. That is, a reduced pressure in the chamber or variations in weight of the projectile will result in variation in the total energy given to the weapon-operating mechanism which, in turn, will affect its cyclic rate or the reliability of its operation. With low-mass projectiles or the type used in training and non-lethal ammunition, the problem is especially severe. Frangible projectiles may not be capable of withstanding high accelerations. The low energy required for launch of these lightweight projectiles may not produce a sufficient reaction or necessitate a high enough chamber pressure to cycle conventional weapon mechanisms. Blank ammunition, that is, a cartridge without a projectile, will not normally be able to cycle a weapon without a muzzle adapter to increase the pressure in the system sufficiently to make the mechanism function.

The problem may also be observed in larger caliber guns, such as 40 mm grenade launchers, where a relatively low-velocity projectile with limited capacity to withstand high accelerations, is launched from an automatic gas-operated weapon. Prior attempts to achieve reliable weapon function, along with low-peak projectile acceleration have included "high-low" ballistic systems wherein propellant is initially burned in a high-pressure section of a partitioned cartridge case and released through orifices into the side containing the projectile at a rate sufficient to limit the peak pressure or acceleration on the projectile. Such a system is described in U.S. Pat. No. 4,686,905 (Szabo). While such systems can provide reduced peak forces available for weapon function, necessitating design compromises in the weapon.

SUMMARY OF THE INVENTION

The primary object of this invention is to provide an ammunition configuration which will provide a more constant impulse to a weapon-cycling mechanism to assure its reliable function independent of the energy imparted to the projectile or even whether a projectile is present. This will permit the launching of low mass or acceleration-sensitive projectiles without exceeding their limitations or the firing of a blank cartridge while still providing reliable cycling of the weapon.

It is a further object of this invention to provide these functions in a conventional blowback-type of weapon with a minimum of changes to the weapon itself, permitting it to fire at reduced velocity, frangible or non-lethal or blank ammunition while still functioning in a normal manner.

It is a still further object of this invention to provide a means for cycling a weapon which uses an ammunition design compatible with existing manufacturing processes to minimize cost and make maximum use of existing production facilities.

These and other objects of the invention may be achieved by the provision of a cartridge suited for blanks or low-mass, frangible projectiles which comprises a cartridge case with cap and forward ends having an inner piston carrying a primer extending into the cartridge case from the cap end. The piston is slideably contained within the cartridge case with a sealed engagement which permits little gas flow therebetween. The piston contains a flash tube that communicates between the primer and the forward end of the piston. At the forward end of the piston, the flash tube may optionally be enlarged to contain a quantity of propellant held within a propellant chamber contained within the piston. Alternately, the flash tube itself may be enlarged to contain propellant.

The cartridge case is provided with a transverse wall located forward of the end of the piston. This wall is pierced by an orifice to permit gases arising from within the cartridge case and the piston flash tube to pass outwardly from the forward end of the cartridge casing. This orifice is sized to cause the piston to recoil under the build-up of gas pressure with sufficient force to cycle the weapon.

A projectile may optionally be inserted into a cylindrical recess in the front portion of the cartridge case forward of the transverse wall. The orifice in such embodiment will permit primer gas, and propellant gas if present, to bleed through and accelerate the projectile upon ignition. The amount of energy imparted to the projectile can be adjusted by varying the size of the orifice as well as the amount of gas generated. This arrangement is particularly suited for relatively fragile projectiles that are not able to sustain excessive acceleration.

Upon ignition of the primer the piston is displaced rearwardly, under pressure from the exploding primer and propellant if present. The piston recoils while the case seats within the chamber, thrusting against the firearm either at the end wall of the chamber or through a casing rim, if present. By reason of such rearward displacement, momentum is imparted to the breech block sufficient to cycle the weapon.

The case and the piston are provided respectively with a inter-engaging stepped portions in order to limit travel of the piston with respect to the cartridge case. This further permits the piston and cartridge case to be ejected together.

The piston may be positioned entirely within the cartridge casing, being outwardly exposed before firing only at the cap end of the casing. Alternately, the end of the piston may be enlarged at the cap end to provide an exposed outer cylindrical periphery that is aligned as an extension of the outside surface of the cartridge casing. In such event, this outside periphery of the piston may carry an ejection groove.

These and other objects of the invention are further achieved by the provision of, in combination with a firearm or weapon having a chamber with a seat at the end thereof, a cartridge for low-mass, frangible projectiles which comprises a cartridge case having a primer at its base and a sabot or piston at its mouth. This piston terminates with an outer annular shoulder that can thrust against a complementary, inwardly-formed step or inclined shoulder formed at the end of the chamber of a fire arm around the entrance to the barrel. The sabot is slideably contained within the cartridge case with a sealed engagement which permits little gas flow therebetween. The sabot can be provided with the longitudinal orifices, diagonal orifices, flutes, or any combination of orifices and flutes to provide a path for propellant gas from the volume of the case behind the sabot to flow to the rear of the projectile, and thence to the barrel of the gun. The projectile is inserted into a cylindrical recess in the front portion of the sabot. The orifices are in communication with this recess to permit propellant gas to bleed through and accelerate the projectile upon ignition. The amount of energy imparted to the projectile can be adjusted by varying the size of the orifices.

A better understanding of the disclosed embodiments of the invention will be achieved when the accompanying Detailed Description is considered in conjunction with the appended drawings, in which like reference numerals are used for the same parts as illustrated in the different figures.

The foregoing summarizes the principal features of the invention and some of its optional aspects. The invention may be further understood by the description of the preferred embodiments, in conjunction with the drawings, which now follow.

DETAILED DESCRIPTION OF THE PREFERRED EMBODIMENTS

Figure 1:
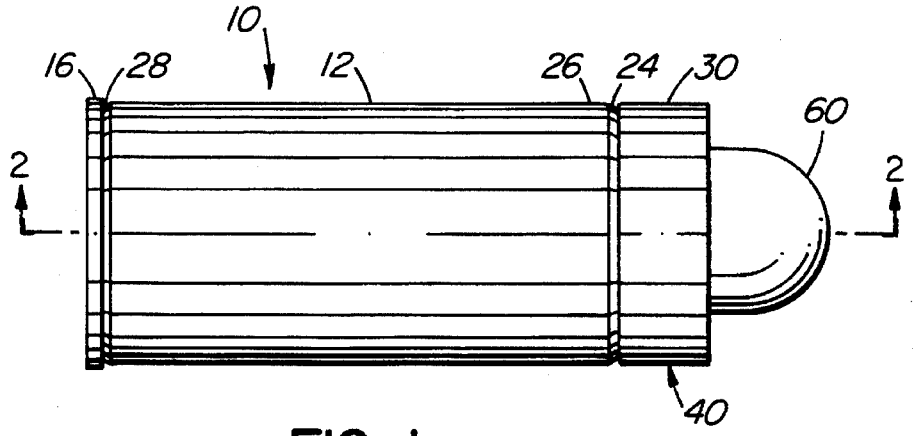
FIG. 1 is a side elevational view of a cartridge in accordance with a first embodiment of the invention.

In describing the preferred embodiments of the subject invention illustrated in the drawings, specific terminology will be resorted to for the sake of clarity. However, the invention is not intended to be limited to the specific terms so selected, and it is to be understood that each specific terms includes all technical equivalents which operate in a similar manner to accomplish a similar purpose.

Figure 2:
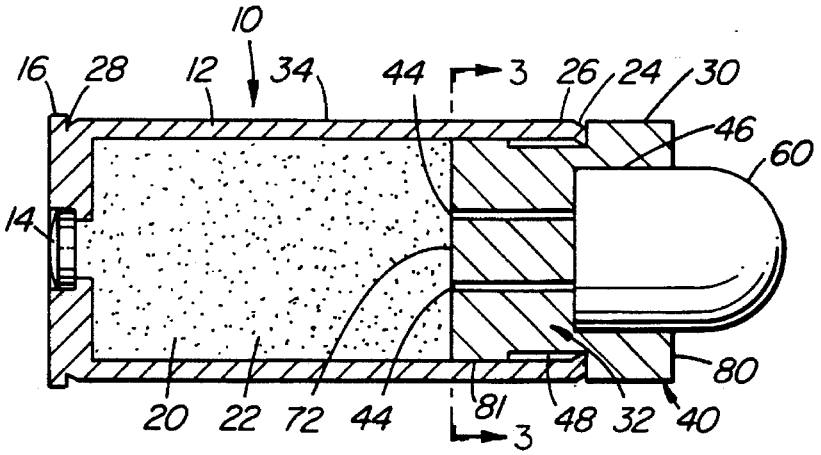
FIG. 2 is a cross-sectional view of the cartridge of FIG. 1, taken along line 2—2 of FIG. 1.
Figure 3:
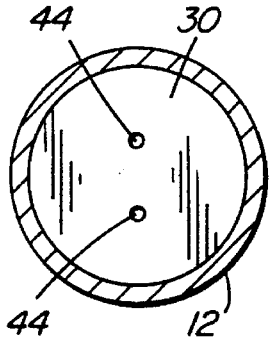
FIG. 3 is a cross-sectional view of the cartridge of FIG. 1, taken along line 3—3 of FIG. 2.

A first embodiment of a cartridge in accordance with the present invention is depicted generally in FIG. 1 through 3. The cartridge 10 comprises a cartridge case 12 containing a primer 14 in the base or head 16 of the case 12 to provide ignition and/or propulsion energy. A conventional propellant 20 may optionally be located within the case cavity 22 to provide the required propulsion energy if the energy of the primer 14 is insufficient to sufficiently excite the weapon and propel the projectile (if included). A flange 24 or crimp 24 can be provided at the mouth or forward end 26 of the case for a purpose to be described hereinafter. An extraction groove 28 is conventionally provided adjacent base 16 for use in the ejection process. Alternatively, a conventional flange (not shown) can be provided.

A one-piece piston or sabot 30 having forward 80 and rearward 72 ends, is inserted in the mouth 26 of cartridge case 12. The outer diameter of at least a portion of the rear portion 32 of sabot 30 is substantially equal to the inner diameter of wall 34 of case 12 to fit snugly and sealingly against the inner surface of wall 34 of case 12, restraining the escape of the propellant gas. The rear portion 32 can be formed with one or more additional portions having sidewalls 81 of decreased diameter, i.e., a diameter less than the inner diameter of wall 34, for the purpose to be described hereinafter. The forward portion 40 of the sabot 30 is larger in diameter than the rear portion 32, being substantially equal to the outer diameter of wall 34, to fit snugly in the chamber 102 of the gun (see FIG. 4).

Longitudinal orifices 44 extend through the rear portion 32 of the sabot 30, opening into and terminating at a cylindrical axial recess 46 formed in the sabot 30 at the forward end 80 of the rear portion 32, to provide a path or gas passage means 44 for propellant gas from the larger area of cavity 22 within the case 12 to the forward end 80 of the sabot 30, rearwardly of the projectile 60, and thence to the barrel 104 of the gun 103. As shown in FIGS. 2 and 3, there are two orifices 44 equidistant from the longitudinal axis of sabot 30 and parallel with the longitudinal axis and each other. However, the precise positioning and number of orifices 44 is not considered to be critical. For example, although two orifices may be provided for balance, it is possible to use a single orifice, located axially or elsewhere.

An inward step 48 defined by the transition between the portions of differing diameter can be formed in the sidewall 81 of the rear portion 32 of sabot 30 rearwardly of and spaced-apart from the front portion 40, for a purpose to be described hereinafter. The projectile 60 is contained in recess 46 in the front portion of sabot 30. In the case of a blank, as will be described in greater detail hereinafter with respect to FIG. 13 and 14, the projectile is omitted, permitting the gas to escape directly down the barrel.

Upon initiation of the primer 14 by the weapon firing pin (not shown), gas is generated by the primer 14 and/or the propellant 20 it ignites. The front portion 40 of the sabot 30 is restrained from moving forward by the step 100 in the chamber 102 of the weapon 103 (see FIG. 14) that is complementary to and engages with the outer annular shoulder 76 formed around the forward end 40 of the sabot 30. Though shown as being perpendicular to the direction of the barrel, the step 100 and shoulder 76 may be obliquely oriented so long as the shoulder 76 may thrust against the step 100. The expanding gas therefore propels the case 12 rearward, imparting momentum to the bolt of the weapon. Concurrently, the gas can flow through the orifices 44 to the projectile 60, beginning its acceleration. The amount of energy imparted to the projectile 60 can be adjusted by varying the size of the orifices 44. In the case of a blank, at this time, the gas is permitted to escape down the barrel causing the flash and noise that simulates the firing of an actual bullet.

The travel of the sabot 30 can be limited by an inwardly displaced flange 24, which may be in the form of a crimp, at the case mouth 26 which interferes with the side of the inwardly formed step 48 in the sidewall 81 of sabot 30 when it reaches the end of its travel. It can also be limited by the sidewall friction combined with decreasing internal pressure, eliminating the need for the step 48 in the sabot 30.

As the projectile 60 accelerates down the barrel, the case 12 and sabot 30 continue to be extracted by the bolt, rearward as a unit, to be ejected in the same manner as a conventional cartridge case is ejected from a recoiling bolt weapon. Because the case 12 is set in motion by the firing, there is reduced chance that it will seize within the chamber 102. This, in turn, allows a lighter gauge of material to be used for the wall 34 of the casing 12.

Figure 4:
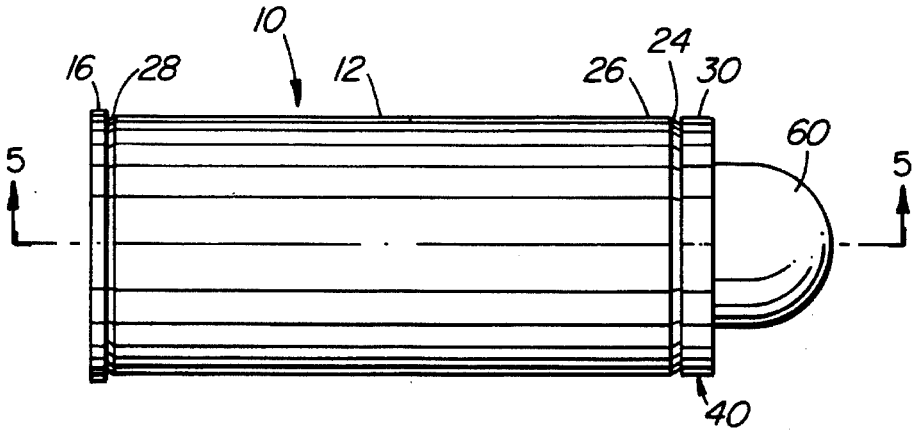
FIG. 4 is a side elevational view of a cartridge in accordance with a second embodiment of the invention.
Figure 5:
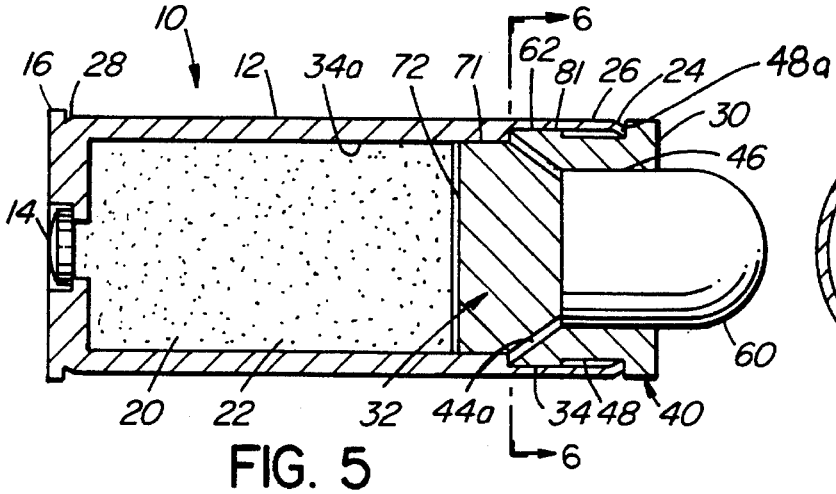
FIG. 5 is a cross-sectional view of the cartridge of FIG. 4, taken along line 5—5 of FIG. 4.
Figure 6:
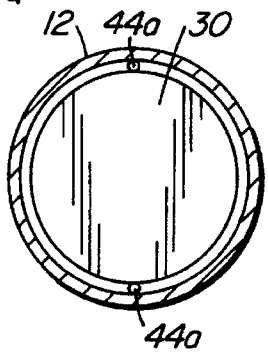
FIG. 6 is a cross-sectional view of the cartridge of FIG. 4, taken along line 6—6 of FIG. 5.
Figure 7:
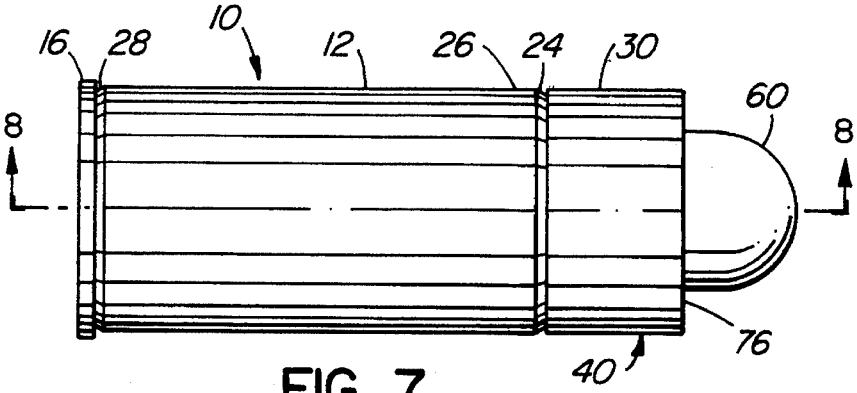
FIG. 7 is a side elevational view of a cartridge in accordance with a third embodiment of the invention.
Figure 8:
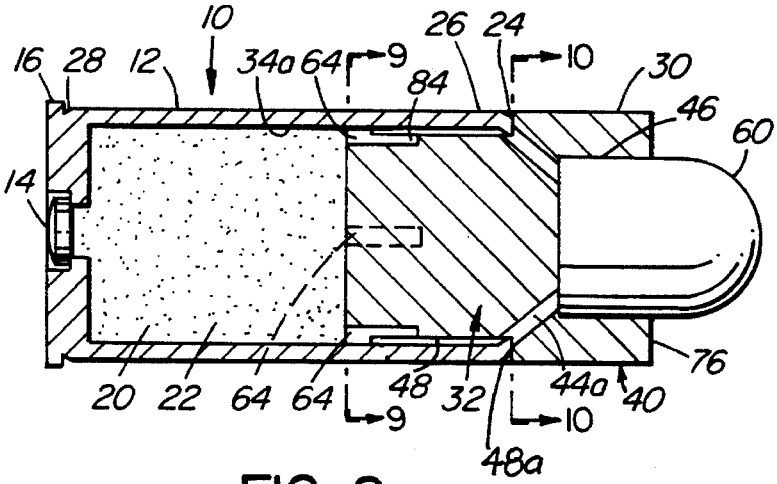
FIG. 8 is a cross-sectional view of the cartridge of FIG. 7, taken along line 8—8 of FIG. 7.
Figure 9:
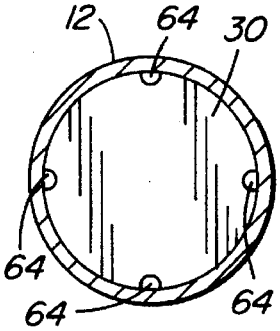
FIG. 9 is a cross-sectional view of the cartridge of FIG. 7, taken along line 9—9 of FIG. 8.
Figure 10:
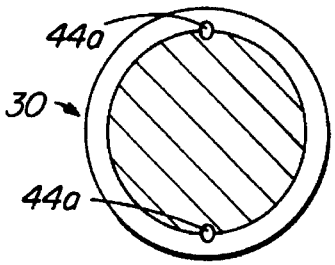
FIG. 10 is a cross-sectional view of the cartridge of FIG. 7, taken along line 10—10 of FIG. 8.

A second embodiment of the invention is shown in FIGS. 4 through 6. In this configuration, the sabot 30 is reduced in diameter at the rear portion 32 by providing an inwardly stepped surface 71 to fit snugly into a case 12 having a thinner, stepped portion 62 defined by a thicker sidewall **34*a* set inwardly from the mouth 26. Also, diagonal orifices 44*a*, which serve as gas passage means 44*a*, are provided in the rear portion 32 of sabot 30. Orifices 44*a* angle outwardly and rearwardly from the forward end 80 of the sabot 30 (being in the case where a projectile is present, the bottom of the recess 46) towards the rear portion 32 of sabot 30, terminating at the inwardly stepped surface 71 where the sabot 30 is of reduced diameter at a location short of the rearward end 83 of the sabot 30. Upon initialization of the primer 14 and/or propellant 20, the gas is completely trapped until the end of the thinner stepped portion 62 in the case wall 34*a* clears the rear end 72 of the sabot 30, permitting the gas to flow through the orifices 44*a* to the projectile 60** and assuring that the weapon receives sufficient operating impulse prior to projectile acceleration.

A third embodiment of the invention in shown in FIGS. 7 through 10. The rear portion 32 of the sabot is fluted by grooves 64 (four being shown but one being sufficient) to permit the escape of gas when the case has moved rearward sufficiently to uncover the terminal end 84 of one of the grooves 64. At that time, gas flows through the grooves 64 along the case wall 34, through the step 48 and through the angled sabot orifices **44*a* from the end wall 48*a* of the step 48 to the base of the projectile 60 causing its acceleration as described above. This design also prevents the propellant gas from reaching the orifices 44*a* and thence the projectile 60 until the movement of the sabot 30 has almost reached its limit, assuring that sufficient energy has been supplied to the bolt to cycle the weapon regardless of the energy supplied to the projectile 60. Further, it eliminates the need for the step 62 in the cartridge case 12 as shown in FIG. 5**.

Figure 11:
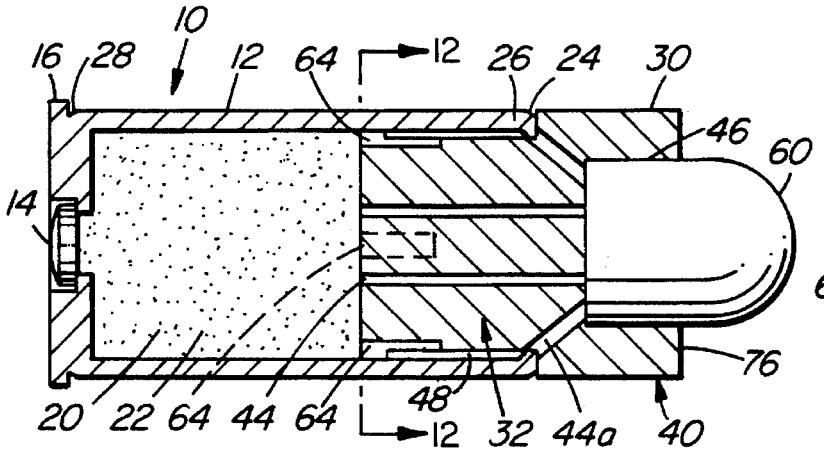
FIG. 11 is a cross-sectional view of a cartridge in accordance with a fourth embodiment of the invention.
Figure 12:
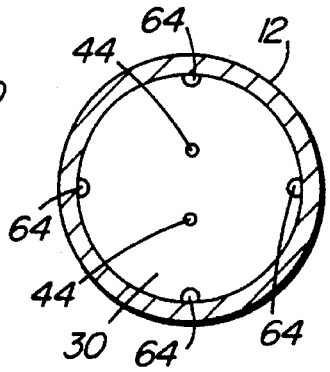
FIG. 12 is a cross-sectional view of the cartridge of FIG. 11, taken along line 12—12 of FIG. 11.

A fourth embodiment of the invention is shown in FIGS. 11 and 12. It is similar to the third embodiment shown in FIGS. 7 through 10, except that it also contains longitudinal orifices 44 extending through the sabot 30, as in the first embodiment as shown in FIG. 2, to permit propellant gas to bleed through and accelerate the projectile 60 immediately upon ignition. Orifices 44 are designed to provide sufficient but limited pressure in the barrel before the case 12 and the bolt have moved rearward sufficiently to uncover the grooves 64 in the sabot 30. During this period the projectile 60 is accelerated to the end of the gun barrel. When the grooves 64 are uncovered, a much greater volume of gas is released, causing more noise and flash than can be obtained with either of the embodiments shown in FIG. 1 or FIG. 3. By proper design of the longitudinal orifices 44, the diagonal orifices **44*a***, bolt mass and propellant parameters, it is possible to obtain equivalent noise and recoil to a conventional weapon firing ball ammunition, while firing a reduced energy projectile.

The same concept, that is, the use of an orifice tailored to open at some point in the travel of the projectile in the barrel, in combination with an orifice to provide initial projectile acceleration, can also be used to provide a boost in acceleration to larger mass projectiles in conventional weapons, increasing their velocities without exceeding the maximum pressure limitations of the weapon and barrel.

Figure 13:
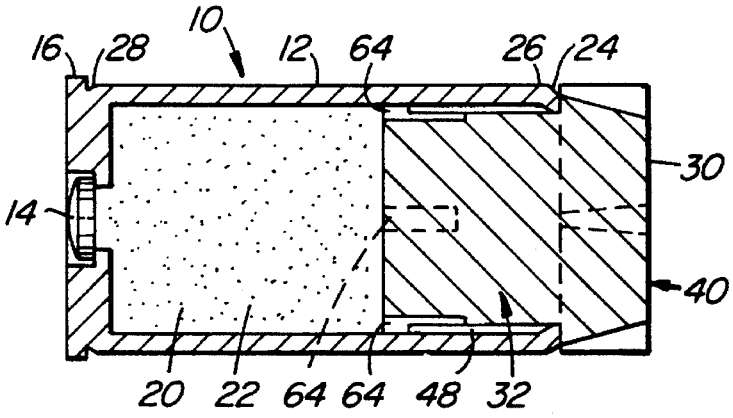
FIG. 13 is a cross-sectional view of a cartridge in accordance with a fifth embodiment of the invention.
Figure 14:
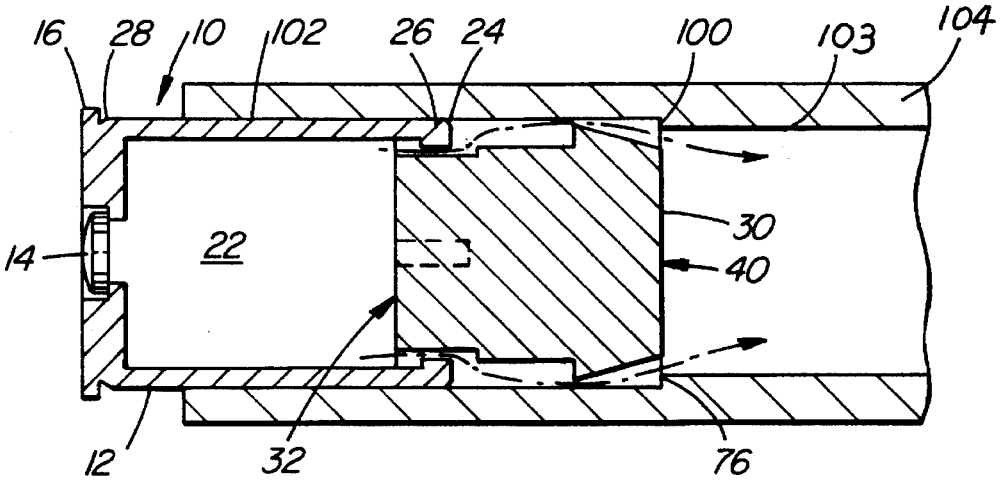
FIG. 14 is a cross-sectional view of the cartridge of FIG. 13, in the fired position.
Figure 15:
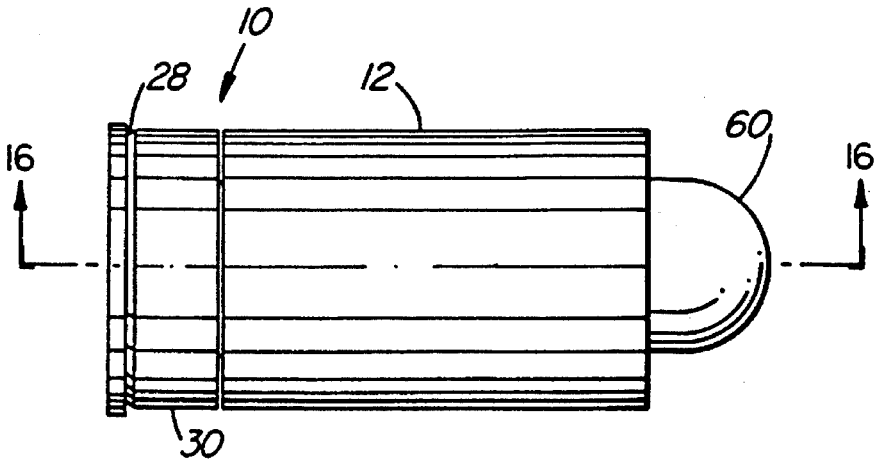
FIG. 15 is a side elevational view of a cartridge in accordance with a sixth embodiment of the invention.
Figure 16:
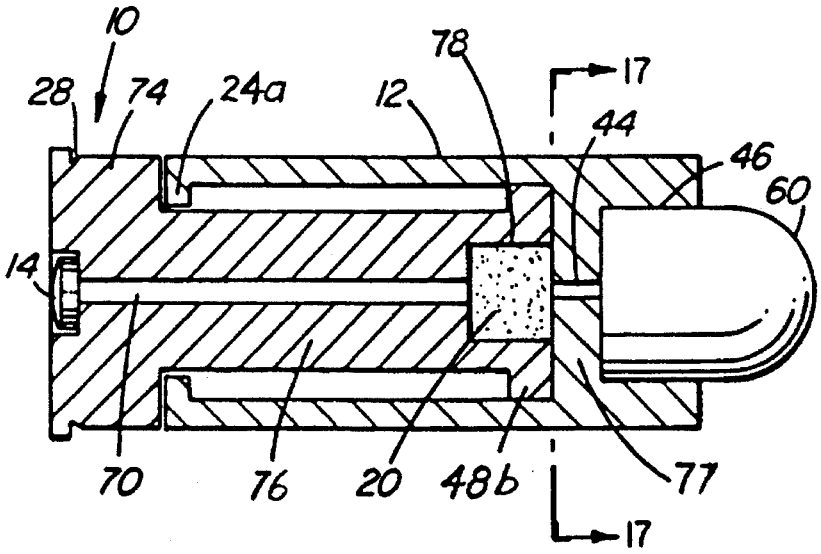
FIG. 16 is a cross-sectional view of the cartridge of FIG. 15, taken along line 16—16 of FIG. 15.
Figure 17:
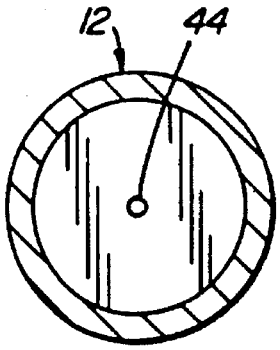
FIG. 17 is a cross-sectional view of the cartridge of FIG. 15, taken along line 17—17 of FIG. 16.

FIGS. 13 and 14 show a fifth embodiment of the invention, a blank cartridge operating on the same principle as the first embodiment shown in FIGS. 1 through 3. The propellant energy is used to accelerate the weapon mechanism and the residual gas energy is released down the barrel when the grooves 64 in the rear portion 32 of sabot 30 are uncovered by the movement of the case 12 with respect to the sabot 30. This provides a means for cycling some weapons without the need of a blank firing adapter.

Another variation of the invention shown in FIGS. 1 through 3 is depicted in FIGS. 15 through 18.

In the embodiment of FIGS. 15 through 18 the role of the case 12 is reversed. Thus the case 12 remains seated, on firing, in the firearm chamber 102 of the firearm 104, thrusting off of the end 100 of the chamber while a piston 74 contained in the case 12 extends rearwardly from the rear or cap end of the case 12 to cycle the weapon. Preferably the piston 74 extends for the greater part or more than half of the casing length into the case 12. More preferably it extends to transverse end wall 70 described further below.

In some weapons this configuration provides more support to the stationary component, the cartridge case 12. For example, propellant gases may be permitted to expand the case 12 against the wall of a tapered chamber seat of the weapon to provide additional bearing surface during the ballistic cycle. This can allow use of a thinner wall case but carries with it the risk that the cartridge 10 may be more resistant to ejection. Alternately, the piston 74, as described next, can protect the cartridge case 12 from excessive shock from expanding propellant.

Low energy ammunition requires significantly less propellant (in the order of 10%) for proper functioning than a conventional cartridge. To assure uniform ignition of the propellant needed to obtain exterior ballistic uniformity, the volume of the cavity retaining the propellant should be correspondingly small. The shape of the chamber is also important so that the energy of the primer is properly transmitted to the propellant. The research conducted in the last century on small arms ammunition has indicated that the optimum loading density, that is the fraction of the volume occupied by propellant, should not be below approximately 0.8 (80% filled). Lower densities permit the propellant to settle differently depending on movement of the cartridge, affecting ignition and propellant burning.

In some cases, the primer may generate enough gas to effect cycling of a weapon. In other cases, some degree of propellant may be required. The invention applies in both cases whether the source of gas within the cartridge is from the primer alone, or the primer combined with propellant.

In this reverse embodiment, the propellant 20 when present is preferably largely positioned within a piston 74 and is in communication with the primer 14 through an elongate flash tube 70 extending the length of the piston. A single longitudinal orifice 44 formed in a transverse wall 77 positioned at the forward end of the case 12, in front of the piston 74, allows gas to escape from the forward end of the cartridge case 12.

The propellant 20, if present, is preferably located largely or completely in a propellant cavity 78 at the front end of the piston 74. The flash tube 70 communicates between the primer 14 and this propellant cavity 78 through the body of the piston 74 which surrounds and contains the flash tube 70 and propellant cavity.

It has previously been established that the ratio of the length of the cavity 78 to its diameter should ideally be between 1 to 1 and 8 to 1, approximately. A cavity that is too short compared to its diameter may not expose enough of the propellant to the direct energy of the primer. A cavity that is too long with respect to its diameter may permit development of a shock wave which may cause detonation of some propellants, or at least allow the development of higher chamber pressures.

The use of a propellant cavity 78 contained within a piston 74 that meets these guidelines, that is, following the practice established in development of prior ballistic systems for dimensioning the propellant cavity 78, can result in some advantages for the rearwardly moving piston design. Since the quantity of propellant used is so small, the configuration of the chamber is even more important in achieving ballistic uniformity than it is in conventional ammunition. Further, because the propellant cavity 78 is relatively small in diameter as compared to a conventional cartridge, the piston wall 76 can be made relatively thick, permitting the use of less expensive materials such as plastics. This advantage arises from the presence of a piston 74 that is able to contain the expansion of gases whether created by the primer or propellant if present. The initial peak pressure is also not exposed to the cartridge case 12 directly, reducing its need for as great a structural strength. This permits the use of lower cost materials in this component as well. As the propellant cavity 71, if properly proportioned, can also provide improved interior ballistic uniformity, there is less round-to-round dispersion on the target, resulting in better accuracy.

Figure 18:
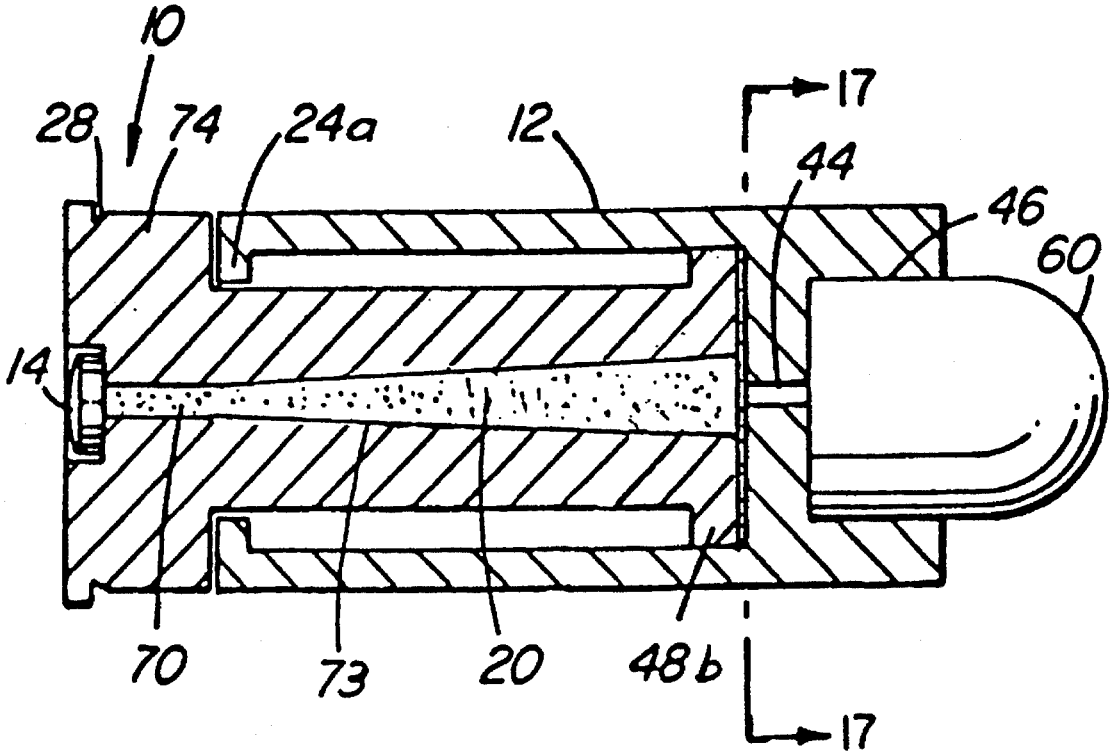
FIG. 18 is an alternate variant of the cartridge of FIG. 17.

A further embodiment based on a rearwardly moving piston is depicted in FIG. 18. In this embodiment the primer 14 is positioned in a piston 74 in communication with propellant 20 which is located in an enlarged flash tube passageway 73 that also serves as the propellant cavity. This enlarged flash tube passageway may be purely cylindrical, or moderately tapered, preferably enlarging towards the forward end of the piston 74. By providing it with preferred proportions, vis preferable from 1 to 1, up to 8 to 1 in its length to width ratio, to maintain confinement of the small quantity of propellant 20 used, proper ignition and burning will be assured. The orifice 44, controls the rate of delivery of gas to the optional projectile as previously described. As in prior embodiments, the shoulders 24*a* and 48*b* prevent the piston from separating from the case 12.

All of the above embodiments can be used in conventional blowback weapons, such as small pistols and submachine guns, with little or no modification of the weapons. Their use in larger pistols which use a form of delayed blowback cycling mechanism and their use in semiautomatic gas-operated weapons, such as most rifles and automatic cannon, may usually require changes to the weapon to convert them to a direct blowback-operated mechanism.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property is claimed are as follows:

1. A cartridge for use in a recoil-operated, automatic cycling, firearm, said cartridge comprising:

(a) a cartridge case with a rearward cap end and a forward casing end and having an inner casing surface and (b) an inner piston with a forward piston end extending into the cartridge case from the cap end for more than half of the length of said case, said piston being slideably contained within the cartridge case in contact with the inner casing surface in a sealed engagement which permits little gas flow therebetween, said piston carrying a primer at its rear end, adjacent to the cap end of the case;

(c) a flash tube contained centrally within the piston that communicates between the primer and the forward end of the piston;

(d) a transverse wall located forward of the forward end of the piston and substantially at the forward end of the cartridge case to create a closed space bounded by the piston, the case and said transverse wall;

(e) an orifice piercing said transverse wall to permit gases arising from within the cartridge case and the piston flash tube to pass outwardly from the forward end of the cartridge case while causing the piston to recoil under the build-up of gas pressure originating from the firing of the primer with sufficient force to cycle the firearm; and (f) interengaging motion limiting portions provided respectively on the case and the piston in order to limit travel of the piston with respect to the cartridge case.

2. A cartridge as in claim 1 wherein the forward end of said piston extends substantially to and terminates at the transverse wall.

3. A cartridge as in claim 2 having propellant present within the case wherein substantially all of the propellant therein is contained within the piston.

4. A cartridge as in claim 1 comprising a propellant cavity located within the piston in communication with the flash tube to contain a quantity of propellant as a propellant chamber.

5. A cartridge as in claim 4 having substantially all the propellant in the cartridge present within the propellant cavity.

6. A cartridge as in claim 5 wherein said propellant cavity has a length to width ratio of between 1 to 1 up to 8 to 1.

7. A cartridge as in claim 1 comprising a recess located in the forward end of the case having said transverse wall as its rearward surface and a projectile positioned in such recess in front of said orifice.

8. A cartridge as in claim 1 wherein said interengaging motion limiting portions comprise interengaging stepped portions.

9. A cartridge as in claim 1 in combination with a firearm having a chamber with a forward end, the forward end of the case of the cartridge being seated on the forward end of the chamber before the firing of the primer.

* * * * *

UNITED STATES PATENT AND TRADEMARK OFFICE

CERTIFICATE OF CORRECTION

PATENT NO. : 5,492,063

DATED : February 20, 1996

INVENTOR(S) : W. A. Dittrich

It is certified that error appears in the above-identified patent and that said Letters Patent is hereby corrected as shown below:

On the title page, item [73], insert SNC Industrial Technologies Inc./ Les Technologies Industrielles SNC Inc. Montreal, Canada Signed and Sealed this Third Day of December, 1996

*Attest:*

Bruce Lehman

BRUCE LEHMAN

*Attesting Officer*

*Commissioner of Patents and Trademarks*